US007082725B2

(12) United States Patent
Visser

(10) Patent No.: US 7,082,725 B2
(45) Date of Patent: Aug. 1, 2006

(54) THRESHOLD TRAY AND CLIP SYSTEM

(76) Inventor: James Edward Visser, 3300-T Joe Ashton Rd., St. Augustine, FL (US) 32092

( * ) Notice: Subject to any disclaimer, the term of this patent is extended or adjusted under 35 U.S.C. 154(b) by 395 days.

(21) Appl. No.: 10/662,537

(22) Filed: Sep. 15, 2003

(65) Prior Publication Data

US 2005/0055978 A1 Mar. 17, 2005

(51) Int. Cl.

| | |
|---|---|
| ***E06B 1/70*** | (2006.01) |
| ***E04B 5/16*** | (2006.01) |
| ***E04B 5/36*** | (2006.01) |
| ***E04F 11/00*** | (2006.01) |
| ***E04F 19/00*** | (2006.01) |

(52) U.S. Cl. ..... 52/182; 52/211; 52/293.3; 49/467; 249/14

(58) Field of Classification Search ..... 49/467; 52/211, 293.3, 182, 189, 102; 249/14
See application file for complete search history.

(56) References Cited

U.S. PATENT DOCUMENTS

| | | | | | |
|---|---|---|---|---|---|
| 1,945,925 | A | * | 2/1934 | Stiefel | 403/2 |
| 2,155,908 | A | * | 4/1939 | Samonds | 249/14 |
| 2,300,113 | A | * | 10/1942 | Faber | 52/92.1 |
| 2,702,421 | A | * | 2/1955 | O'Sullivan | 249/19 |
| 2,939,500 | A | * | 6/1960 | Grant | 269/102 |
| 3,144,943 | A | * | 8/1964 | Punt | 211/40 |
| 3,170,269 | A | * | 2/1965 | Dunnington | 52/293.3 |
| 3,236,012 | A | * | 2/1966 | Laven | 52/184 |
| 3,334,455 | A | * | 8/1967 | Russell | 52/126.4 |
| 3,636,673 | A | * | 1/1972 | Monroe | 52/293.3 |
| 3,778,931 | A | * | 12/1973 | Donaldson | 49/380 |
| 3,984,952 | A | * | 10/1976 | Loomis | 52/127.1 |
| 4,905,414 | A | * | 3/1990 | Campbell | 49/469 |
| 5,915,501 | A | * | 6/1999 | Lodi et al. | 187/333 |
| 6,938,380 | B1 | * | 9/2005 | Friedman et al. | 52/30 |

FOREIGN PATENT DOCUMENTS

| | | | |
|---|---|---|---|
| JP | 6-10501 | * | 1/1994 |

* cited by examiner

*Primary Examiner*—Robert Canfield
(74) *Attorney, Agent, or Firm*—Mark J. Young

(57) ABSTRACT

In recent decades within the building industry, there has been a trend toward mass production of building components. The trend has included every part of structures except for the concrete slab the building is built on. The "Threshold Tray and Clip System" uses mass-produced products to be applied to construction of slabs and foundations, allowing sill steps to be built in rough openings with pre-fabricated form parts. The forms remain in the concrete and are permanent. This means that consistent results can be expected. Other mass-produced products, such as door systems, will fit into rough openings more accurately. Over-all quality of the structure will be increased.

14 Claims, 16 Drawing Sheets

FIG 3
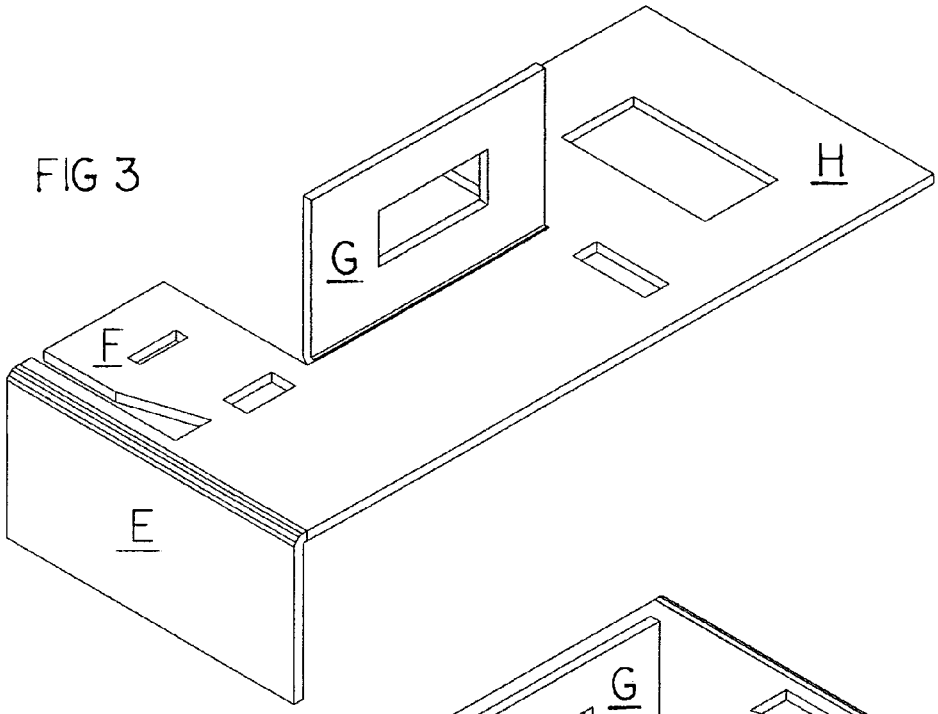
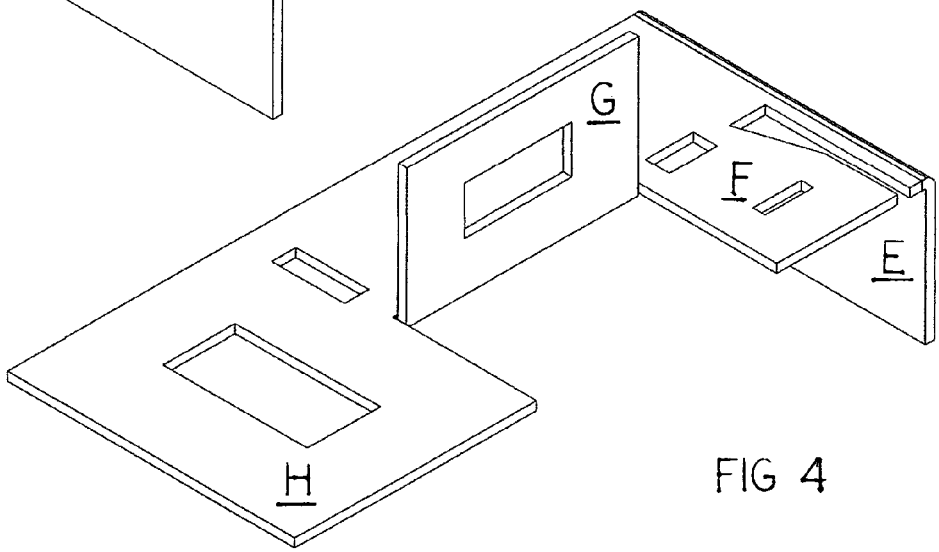
FIG 4

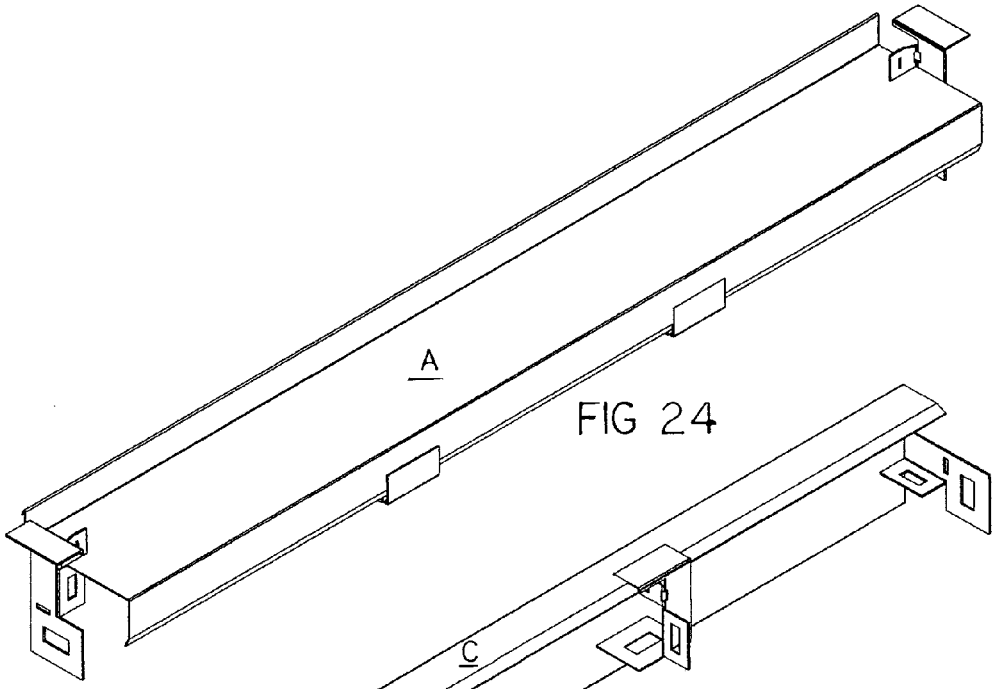
FIG 24
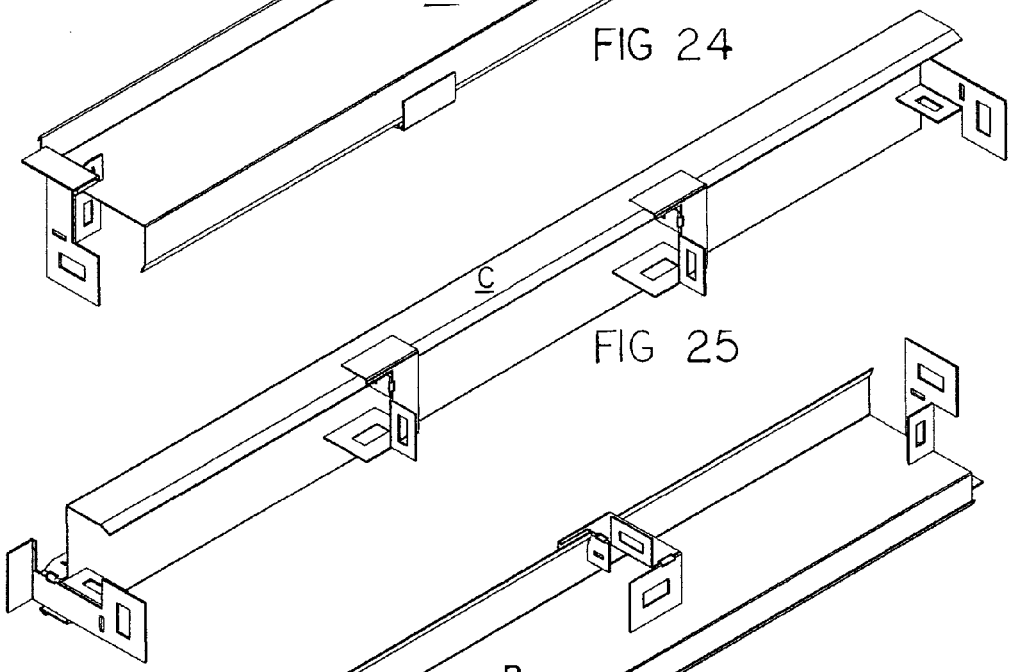
FIG 25
FIG 26

THRESHOLD TRAY AND CLIP SYSTEM

BACK GROUND OF THE INVENTION

Hurricane Andrew came through south Florida with such fury that it illuminated the need for door entry systems and glass doors in residential and small commercial construction to be reinforced against blow-in. The construction industry modified its practice of mounting door entry systems and sliding glass door units, used in slab construction, directly on the slab. The "new method" in use, is to cast a step into the slab using a piece of lumber. The step is normally cast using a nominally dimensioned piece of lumber, resulting in a step that is one and one-half inches deep and five and one-half to nine and one-half inches in width. The lumber is removed after the concrete sets. The entry system or sliding glass-door frame is set into the pocket of the step in the slab.

The use of warped or split lumber, improperly positioned or secured lumber, and destruction of the concrete edge when removing the lumber form, are some of the practices that result in non uniform step dimensions. Considerable time and effort is expended in some cases to repair the step. Manufacturers cannot be sure that their doors will meet design strength when installed in uneven openings. Therefore, I have conceived "The Threshold Tray and Clip System" to fill a need in the commercial and housing building industry.

BRIEF SUMMARY OF THE INVENTION

The "Threshold Tray and Clip System" is comprised of a tray and three clips. The tray, slightly less than one foot in width, four inches in depth, and ten feet in length, is a sheet of suitable material, formed into a Z cross sectional shape. The clips mount the tray to the block foundation-wall commonly found in residential and light commercial slab construction. The "Threshold Tray and Clip System" is a form that remains in the concrete slab after cure.

When the "Threshold Tray and Clip System" is used in slab construction, it results in a finished, uniform, and dimensionally correct reinforced step in the slab at a rough opening. The "Threshold and Clip System" requires nothing beyond simple installation, and is a labor saving method of step construction. It allows the door vendors to correctly install doors, insuring the door manufacturers that their doors will meet local blow-in code requirements.

DESCRIPTION OF DRAWING VIEWS

Figures 1, 2:
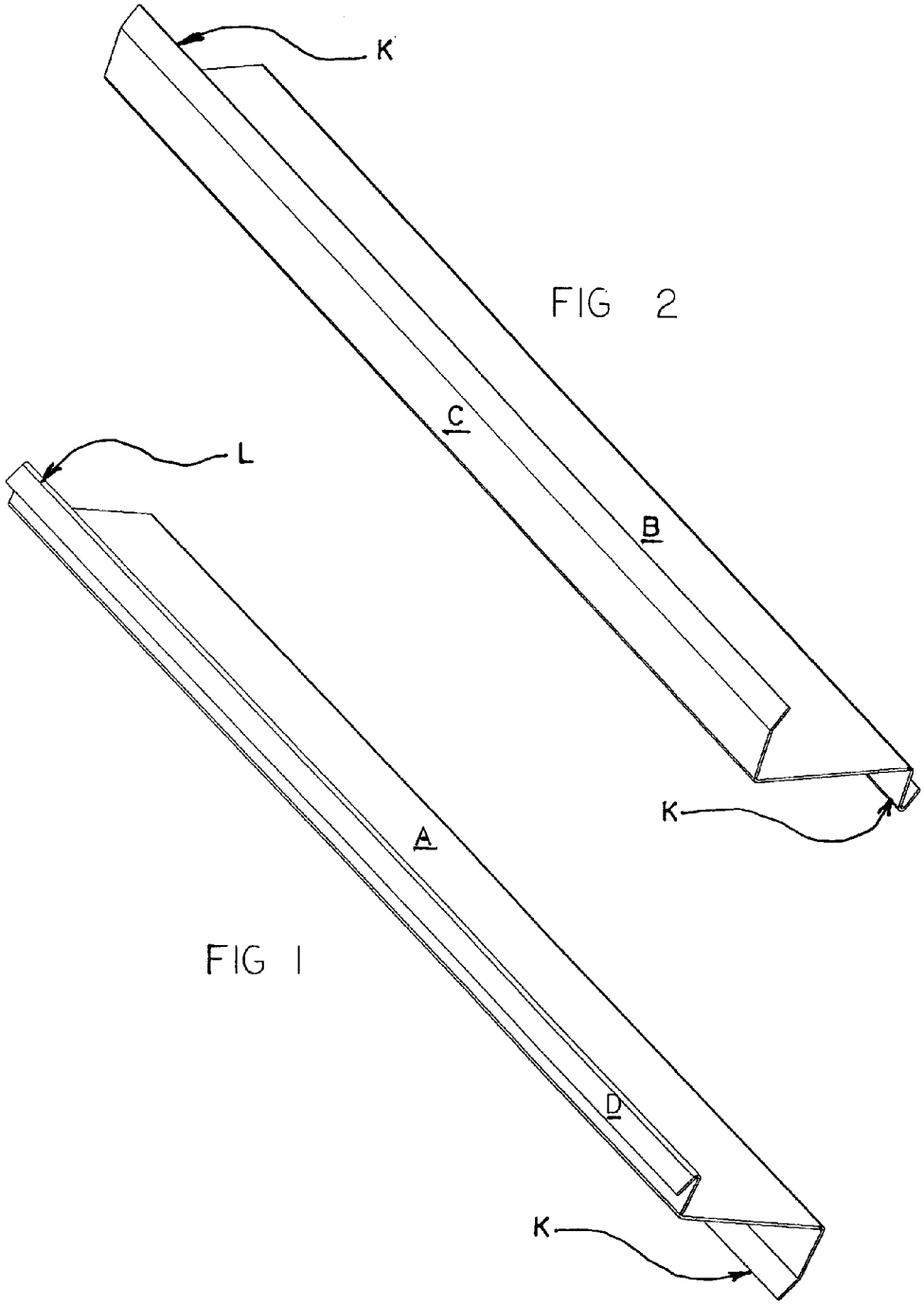

FIG. 1. This is a view of a TRAY with the inside of the TRAY facing the viewer. This view shows the TRAY in an upright position.

FIG. 2. This view shows the TRAY in an upside down position with the outside of the TRAY facing the viewer.

FIG. 3. This is a view of a CLIP.

FIG. 4. This is a view of the CLIP from the opposite viewing angle.

Figure 5:
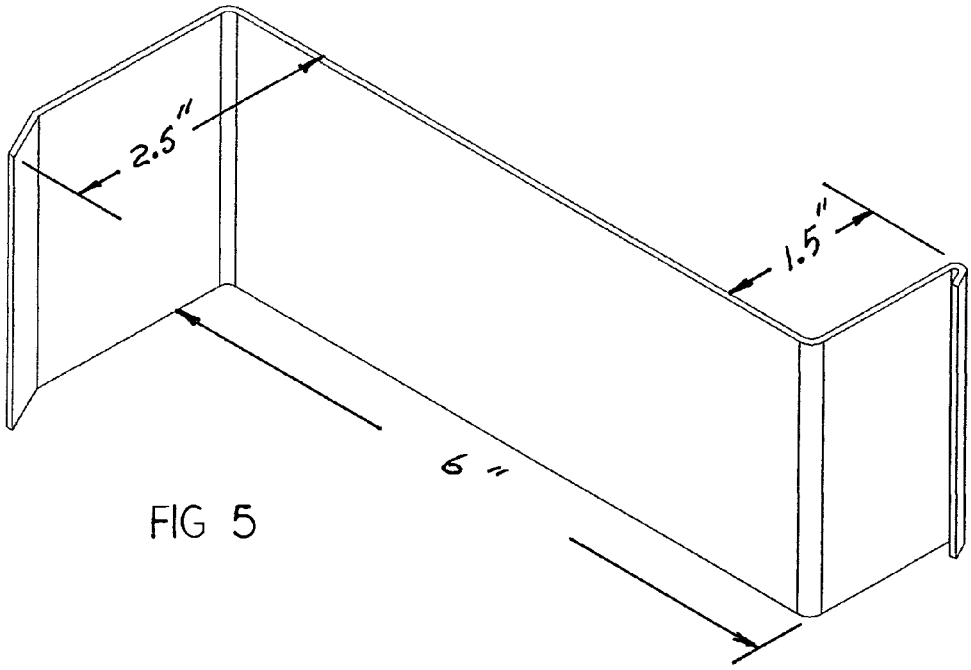

FIG. 5. The CLIP in this view is shown with the dimensions that are relevant to the invention.

Figure 6:
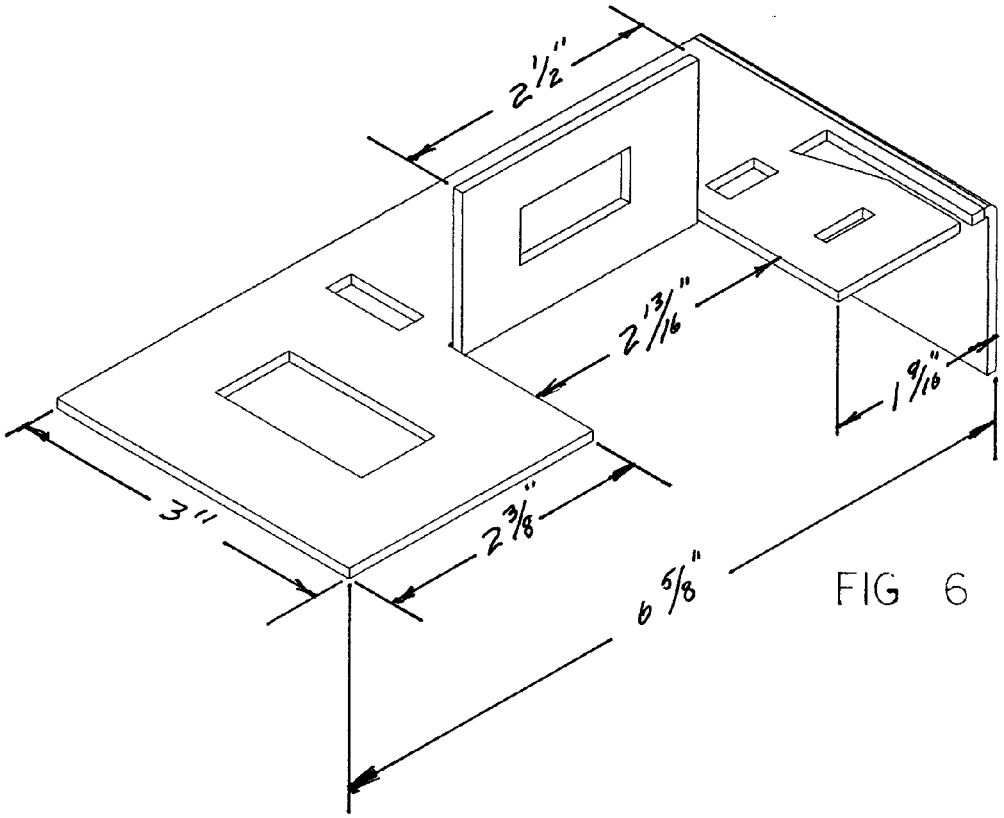

FIG. 6. This view shows a shortened TRAY with the dimensions relevant to this invention.

Figure 7:
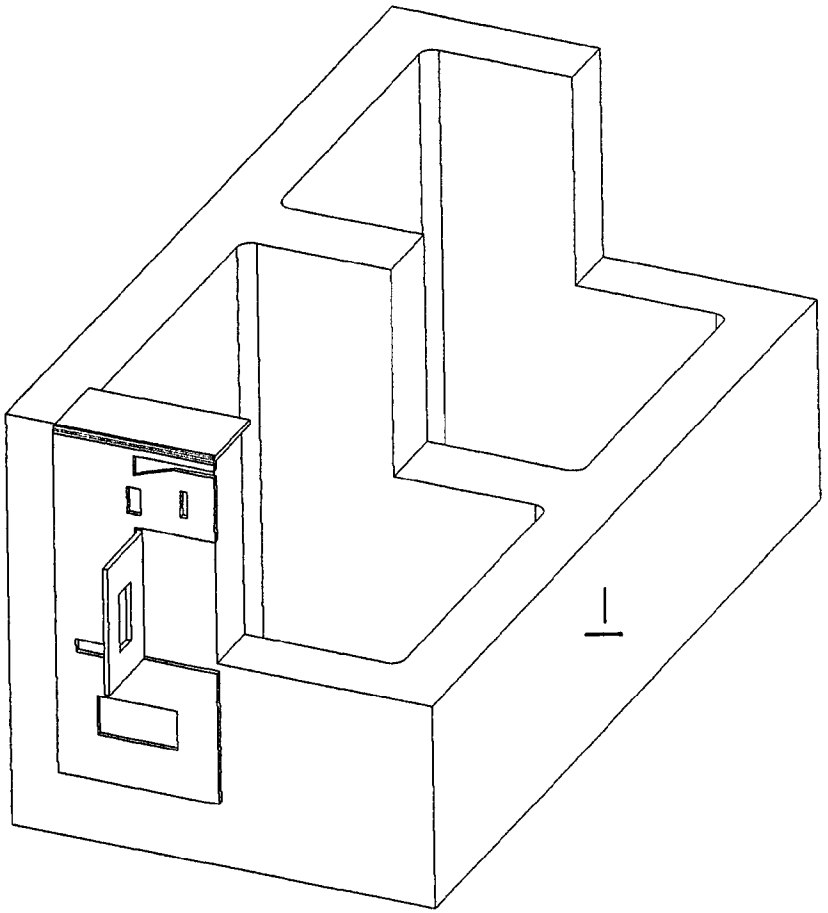

FIG. 7. In this view, a CLIP is set on a masonry chair-block in the position that places it at the left side of a rough opening in a foundation wall, as seen from outside the building.

Figure 8:
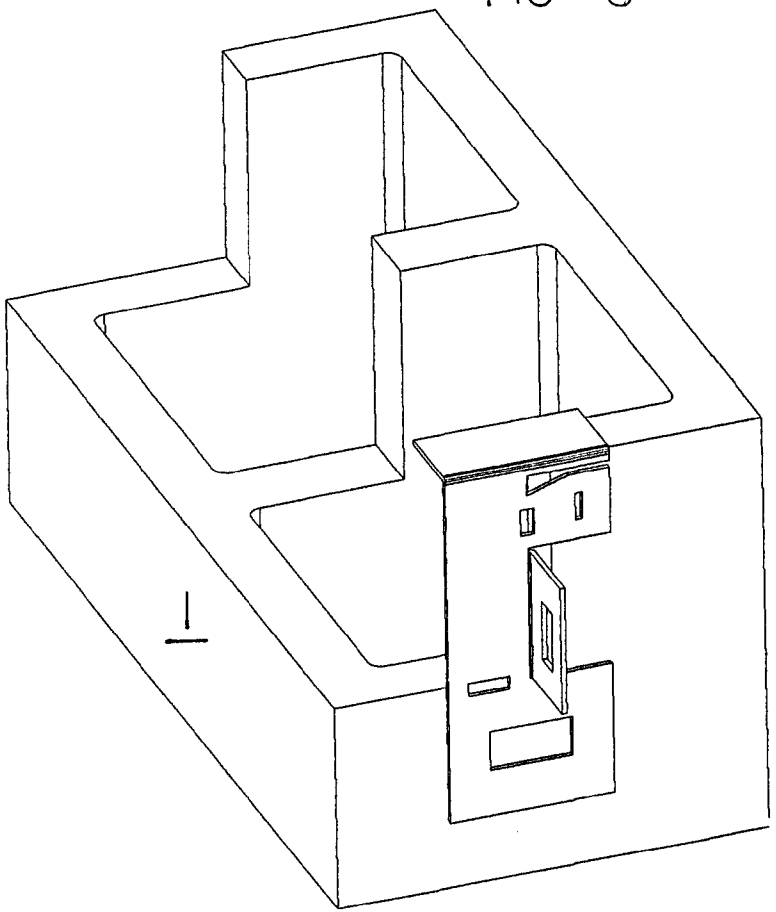

FIG. 8. This view shows a CLIP set on a masonry chair-block in the position that places it at the right side of a rough opening in the foundation wall.

Figure 9:
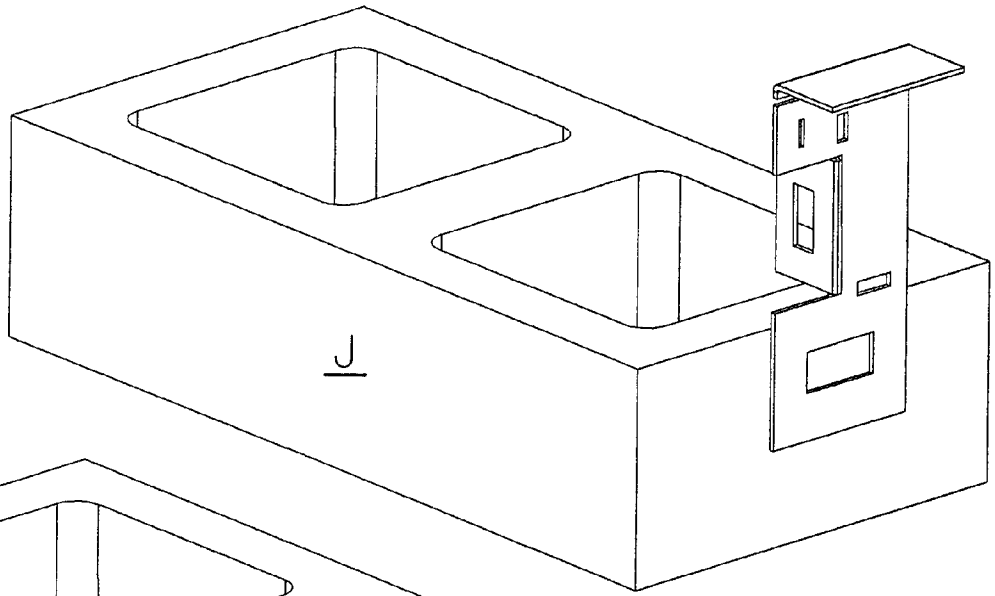

FIG. 9. This view shows a CLIP that is placed on a masonry half-high block in one of two positions that are used in the invention.

Figure 10:
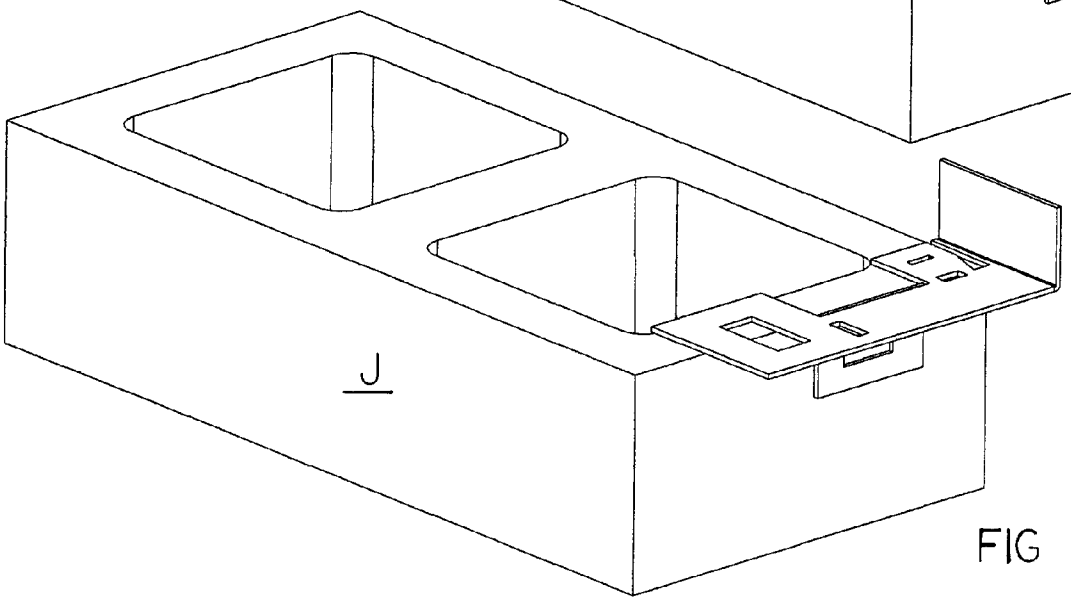

FIG. 10. This view shows a CLIP that is placed on a masonry half-high block in the second of two positions that are used in the invention.

Figure 11:
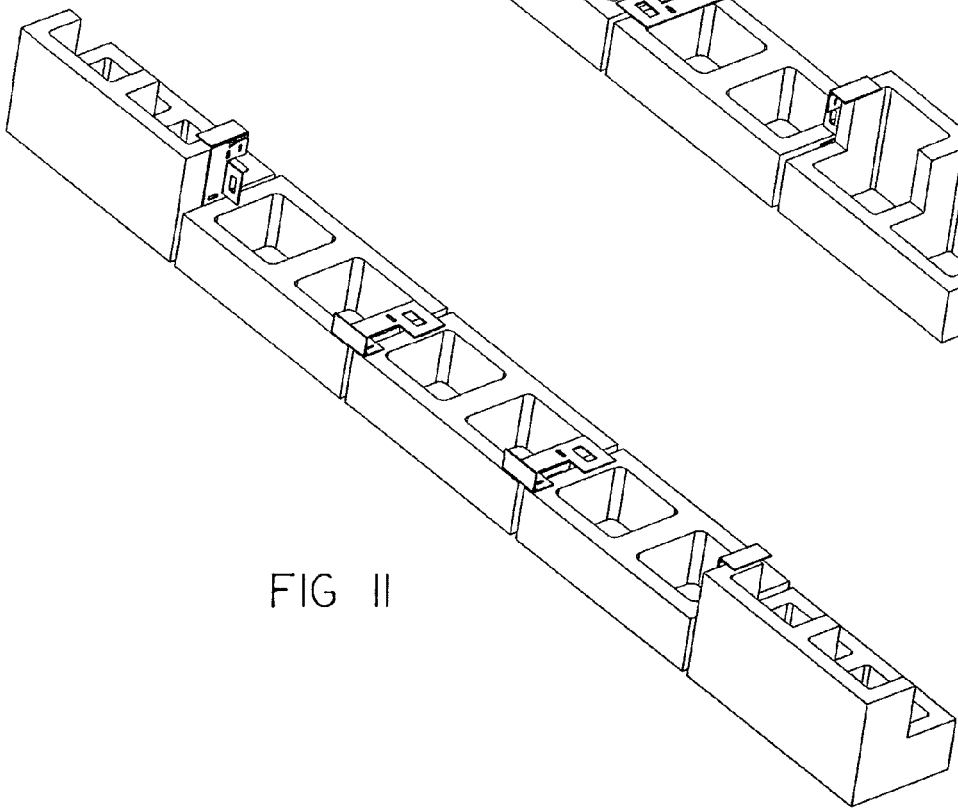

FIG. 11. This view shows the rough opening with the CLIPS and masonry blocks set in mortar in the foundation wall. This view is seen from outside the wall.

Figure 12:
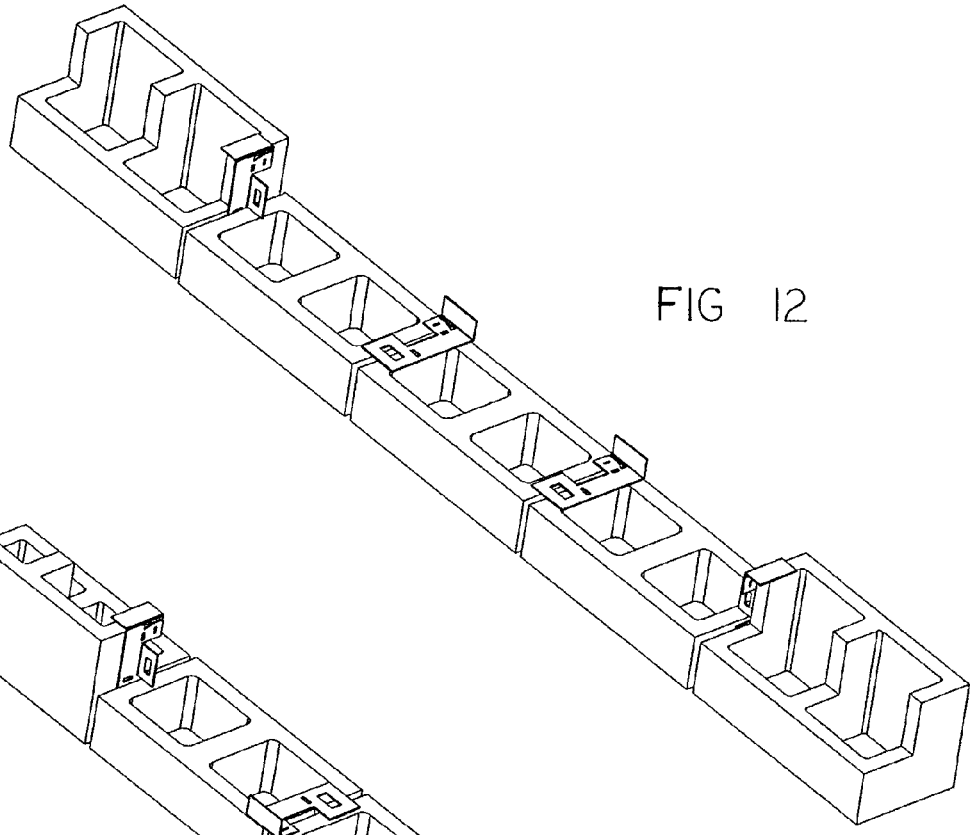

FIG. 12. This view shows the same rough opening as shown in FIG. 11. This view is seen from inside the wall.

Figure 13:
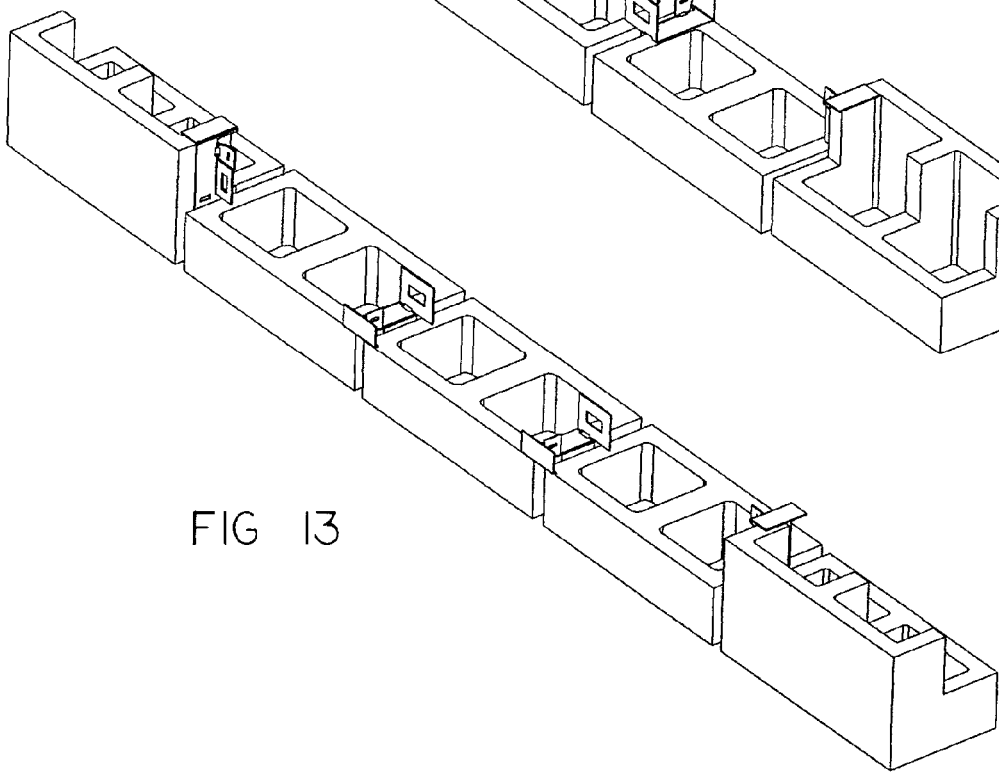

FIG. 13. This view shows the same rough opening, viewed at the same angle as shown in FIG. 11. In this view, the CLIPS have been bent to support and fix the TRAY FIG. 14. This view shows the same rough opening, viewed at the same angle as shown in FIG. 12. In this view, the CLIPS have been bent to support and fix the TRAY.

Figure 15:
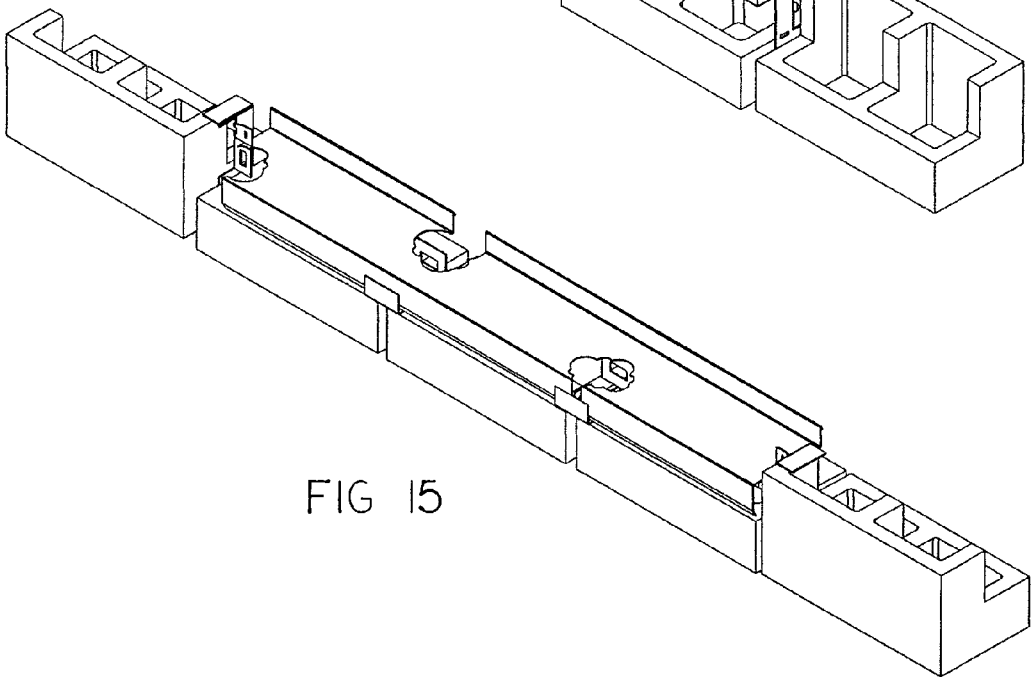

FIG. 15. This view shows the same rough opening, with the same bends to the CLIPS, and from the same angle as FIG. 13. In this view, a TRAY with viewing cutouts has been placed in the rough opening. The relationship between the TRAY and the CLIPS in their various positions is shown in this view.

Figure 16:
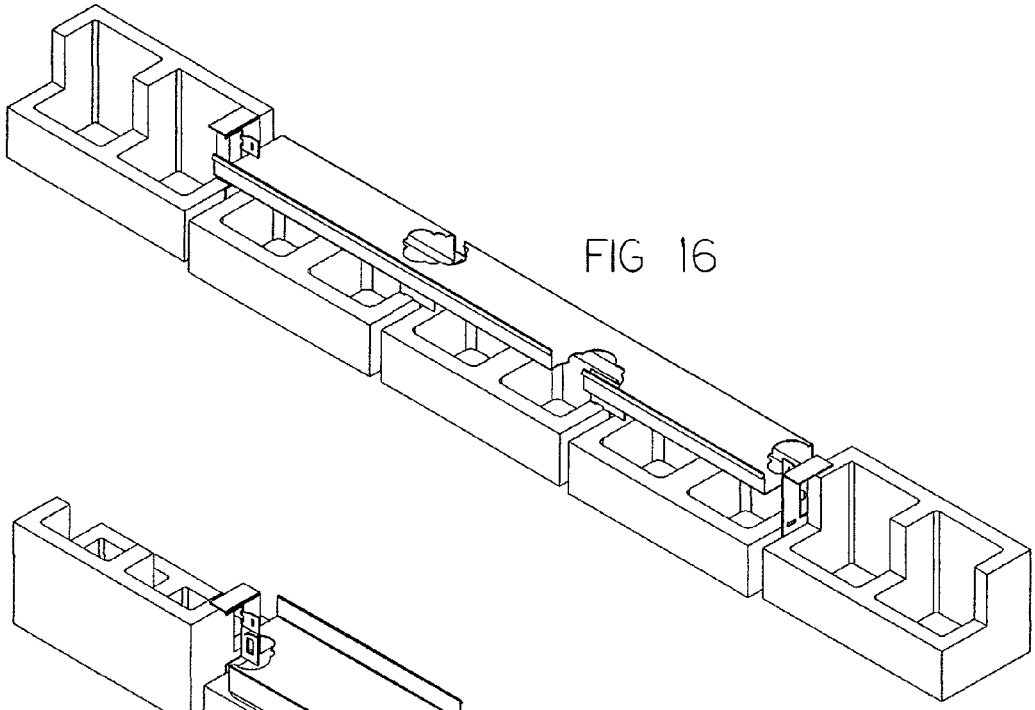

FIG. 16. This view shows the same rough opening as FIG. 15, except in this view the rough opening is seen from inside the wall.

Figure 17:
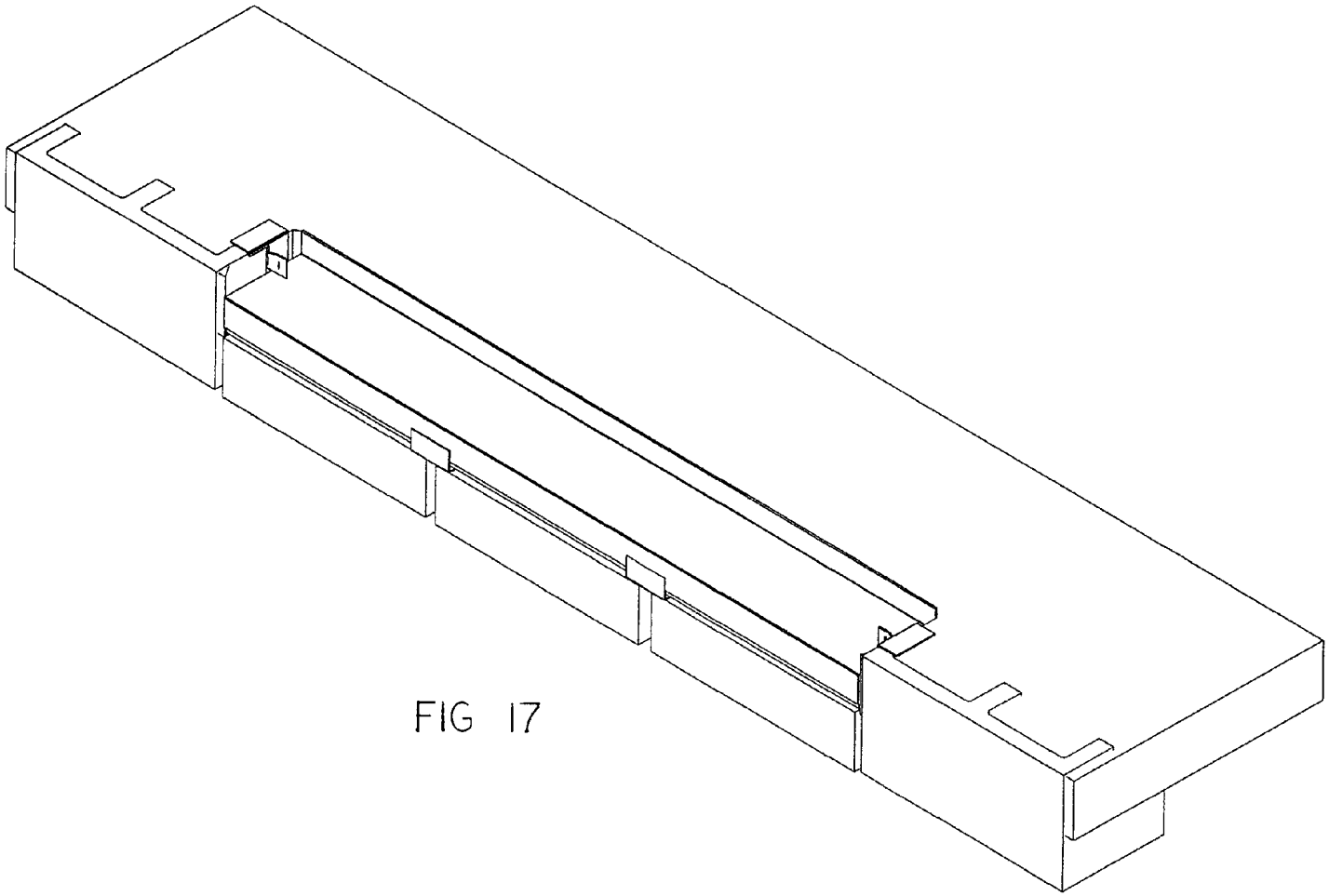

FIG. 17. This view shows a completed installation of the THRESHOLD TRAY AND CLIP SYSTEM in the same rough opening as shown in FIGS. 11 through 16. The concrete floor has been poured and the TRAY has formed the step. This view is seen from out side the foundation wall.

Figure 18:
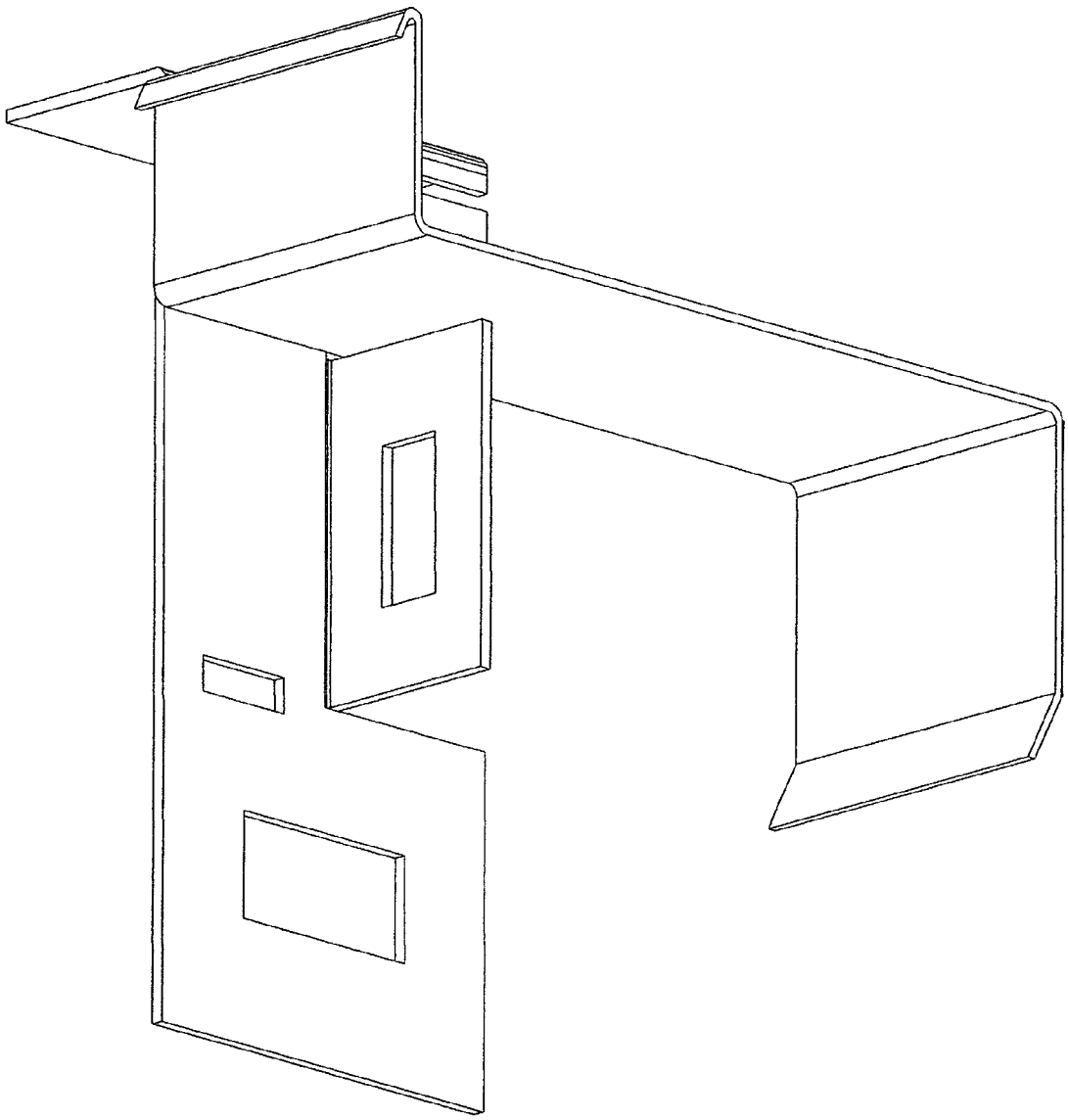

FIG. 18. This view is of a TRAY section and a CLIP. It shows the positional relationship between the TRAY and a CLIP as if the CLIP were set on a masonry chair-block. The view is seen from underneath the TRAY section.

Figure 19:
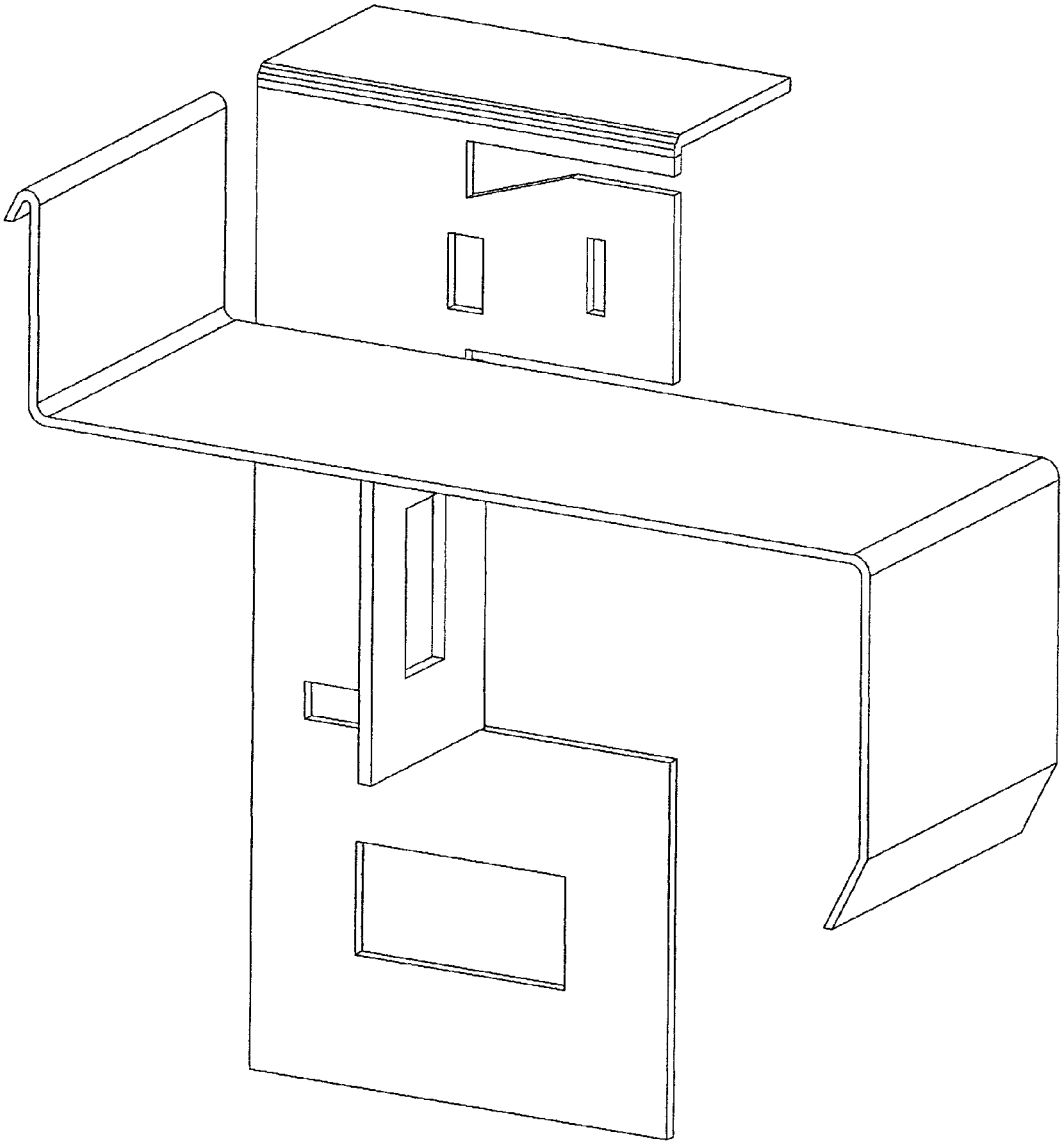

FIG. 19. This view is of the same TRAY and CLIP as shown in FIG. 18. This view is seen from above the TRAY section.

Figure 20:
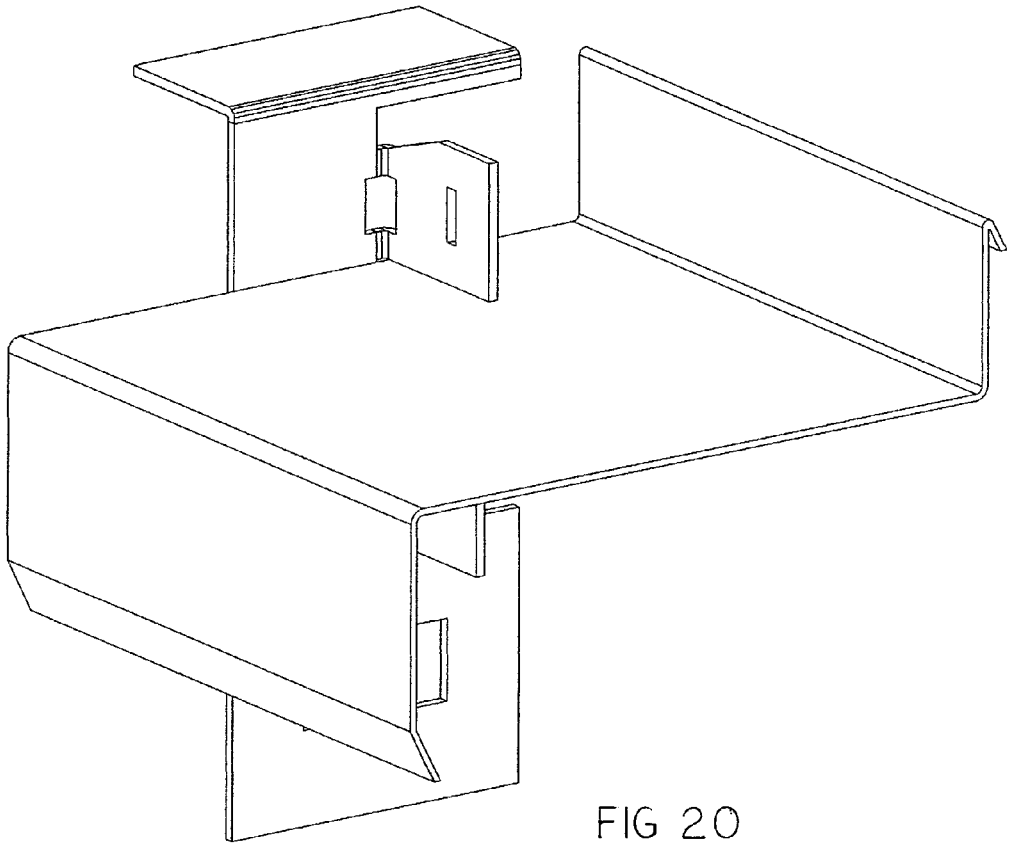

FIG. 20. This view is of a TRAY section and a CLIP. It shows the positional relationship between a TRAY and a CLIP as if the CLIP were set on a masonry chair block as shown in FIGS. 7 and 8. In this view, the CLIP locking-tab has been bent into its locking position to fix in place the end of the TRAY. This view is seen from above the TRAY section.

Figure 21:
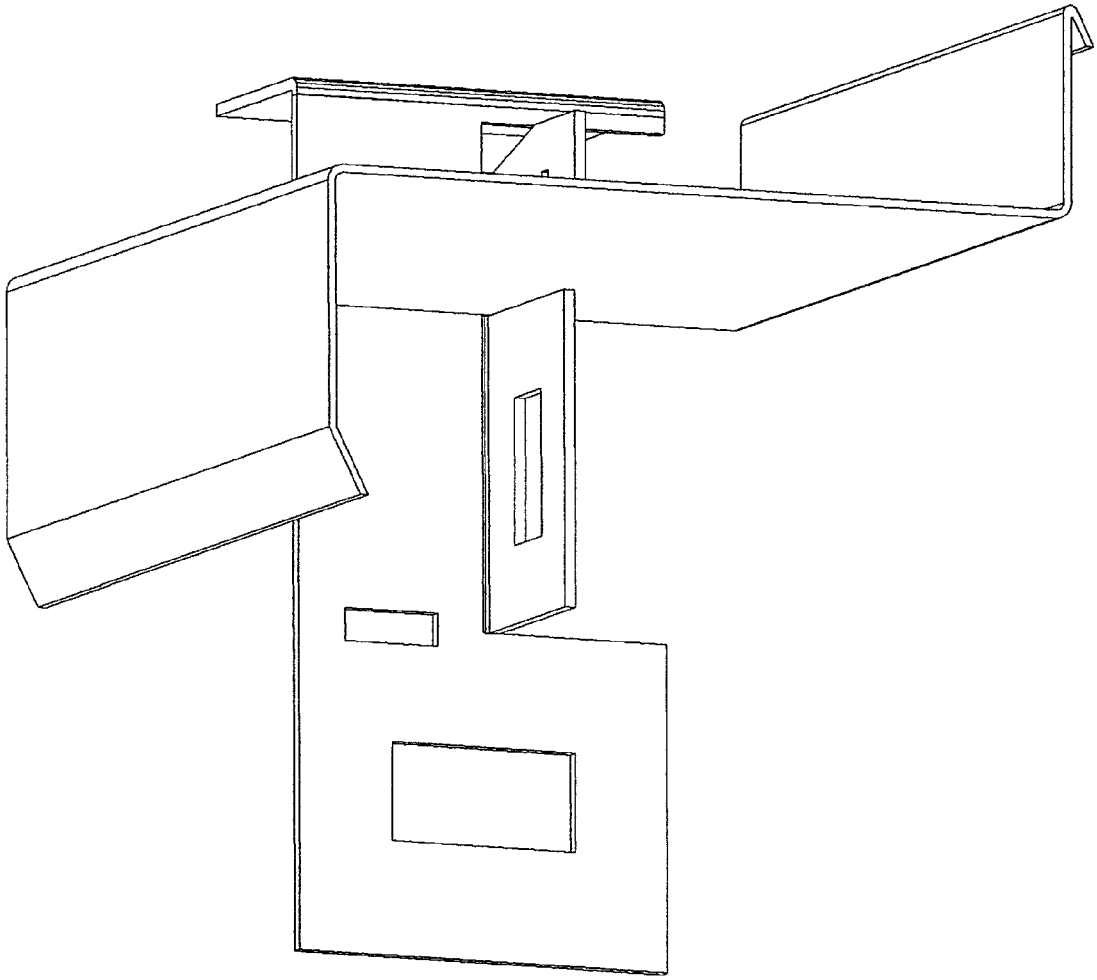

FIG. 21. This view is of the same TRAY section and CLIP as in FIG. 20. This view is seen from underneath the TRAY section.

Figure 22:
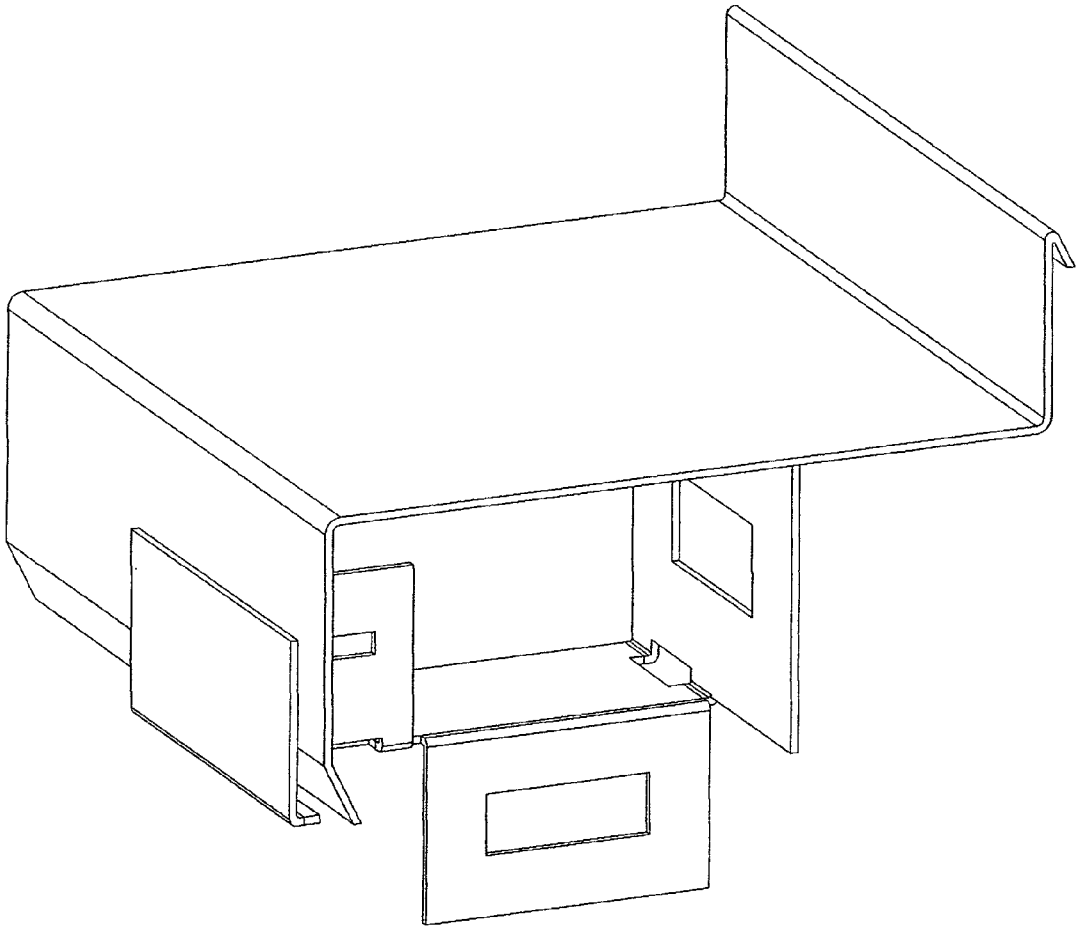

FIG. 22. This view is of a TRAY section and a CLIP. It shows the positional relationship between a TRAY and a CLIP as if the CLIP were set on a masonry half-high block as shown in FIG. 10. The CLIP locking-tab has been bent into the alternate locking position to fix the front of the TRAY in place between the locking-tab and the face flange of the CLIP. The tray-support-tab of the CLIP has been bent in a position to support the TRAY. This view is seen from above the TRAY section.

Figure 23:
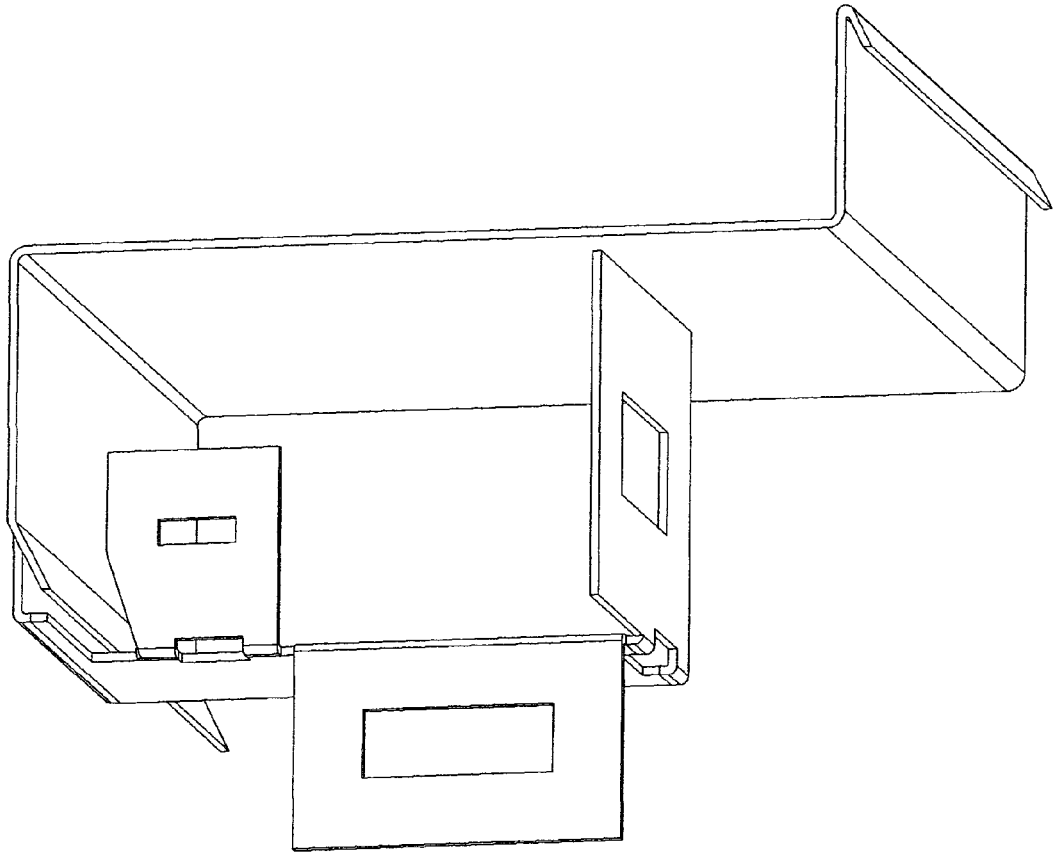

FIG. 23. This view is of the same TRAY section and CLIP as shown in FIG. 22. This view is seen from underneath the TRAY section.

FIG. 24. This view shows the "Threshold Tray and Clip System" in an assembled condition with the top of the TRAY (reference character A) facing up.

FIG. 25. This view shows the assembly shown in FIG. 24, except that the assembly is rotated one-quarter turn so that the front of the TRAY (reference character C) is facing up.

FIG. 26. This view shows the assembly shown in FIG. 24, except that the assembly is rotated one-half turn so that the bottom surface of the TRAY (reference character B) is facing up.

THE LIST OF REFERENCE CHARACTERS

A—The top surface of a TRAY.
B—The bottom surface of a TRAY.
C—The outside surface of the TRAY, also called the front of the TRAY.
D—The inside surface of the TRAY, also called the back of the TRAY.
E—The face-flange of a CLIP.
F—The locking-tab of a CLIP.
G—The mounting and locking-flange of a CLIP.
H—The mounting and support-tab of a CLIP.
I—A masonry chair block.
J—A masonry half-high block.
K—The lower edge of the front (outside) of the TRAY.
L—The upper edge of the back (inside) of the TRAY.

DETAILED DESCRIPTION OF THE INVENTION

The "Threshold Tray and Clip System" is comprised of two different manufactured parts that are supplied in various quantities to make up the total needed to construct a form that shapes the poured concrete floor of a building. The purpose of the form is to construct a step in the rough opening of exterior doorways that will accept the sill of exterior door systems and sliding-glass doors. The form stays in the poured floor and becomes part of the floor of the building. The TRAY part of the system is manufactured in lengths of 10-feet from 14 gauge galvanized steel sheet. FIGS. 1 and 2 show a TRAY seen from different angles. TRAYS can be set end-to-end or cut to length on the job-site to fit any width of rough opening. The CLIP part of the system is stamped from 16 gauge galvanized steel sheet. The CLIPS are supplied in an original configuration that allows them to be hand bent on the jobsite to use two different methods of holding the TRAY. FIGS. 3 and 4 show a CLIP seen from different angles.

When the rough opening is built that will utilize the "Threshold Tray and Clip System" two styles of masonry block are required. The chair block as seen in FIGS. 7 and 8, and the half-high block as seen in FIGS. 9 and 10, are set with the chair blocks on the outside edges and the half-high blocks in the middle to form the width of the rough opening. A rough opening like the one described can be seen in FIGS. 11, 12, 13, 14, 15, 16, and 17.

The step in the rough opening has specific dimensions. The depth of the step is measured from the front (reference character C) of the TRAY to the front-side of the back (reference character D) of the TRAY. This dimension is 6 inches and is shown in FIG. 5. The height of the step is measured from the lower edge of the front surface (reference character K) of the TRAY to the top surface (reference character A) of the TRAY. This dimension is 2½ inches and is shown in FIG. 5. The height of the floor above the step is measured from the top surface of the TRAY to the upper edge of the back surface (reference character L). This dimension is 1½ inches and is shown in FIG. 5. When the TRAY is set in the rough opening between the chair blocks, with the front face resting on the half-high blocks, flush with the outside of the half-high blocks, and the top surface on a horizontal plane, a step will be formed. The step will measure 6 inches deep by 1½ inches lower than the floor. The width of the step will be whatever the building plan describes for that rough opening, which can be achieved by adding or subtracting half-high blocks and adding TRAYS or trimming the TRAY to fit. A view of a completed step is shown in FIG. 17.

In order for the TRAY to become a form, it must be fixed in place in the rough opening while the concrete floor is poured. The CLIP is the form-locating device used in the "Threshold Tray and Clip System". The CLIP connects the TRAY to the foundation wall. The CLIPS are mortared between the masonry blocks when the blocks are set. The block mason applies mortar to the block with a trowel in the normal way before placing the CLIP on the block. The CLIP is pressed to the mortar in the appropriate location. Then the block mason sets the block, straight and level, in the foundation wall. FIGS. 7 and 8 show the approximate position the CLIP will have on a chair block at either end of the rough opening. When placed on the chair block the part of the CLIP that will be imbedded in mortar is the mounting and support tab (reference character H, in FIGS. 3 and 4). The approximate position of a CLIP on a half-high block, when the half-high block is adjacent to a chair block is shown in FIG. 9. In FIGS. 11 and 12, the CLIPS that are located between a chair and half-high block are shown in their relative positions. In order for the TRAY to form the step at the correct height, the CLIP must be located accurately relative to the floor. To accomplish this the CLIP has a locating flange (reference character E in FIGS. 3 and 4). The flange rests on the upper surface of the chair block, which is the same height as the floor surface. To see the relationship of a CLIP face flange, chair block, and floor in a finished installation, refer to FIG. 17. FIG. 10 shows a CLIP placed on a half-high block in the position it occupies when two half-high blocks are adjacent. When placed on a half-high block in this location the part of the CLIP that will be imbedded in mortar is the mounting and locking flange (reference character G, in FIGS. 3 and 4). Again, the face flange (reference character E) is used to locate the CLIP. The inside surface of the face flange should be set flush with the outer surface of the foundation wall. The relative position of the CLIP and the half-high block, when installed in a foundation wall can be seen in FIG. 11. When the mortar sets, the CLIPS will be firmly locked in the foundation wall.

In order that the CLIPS hold the TRAY in the correct position, tabs on the clips must be bent to accommodate the tray. These tabs, and the spaces between them must be manufactured to specified dimensions. The dimensions of the CLIP relevant to this invention are shown in FIG. 6. The tabs that are to be bent are identified in FIGS. 3 and 4 with reference characters F and H.

Figure 14:
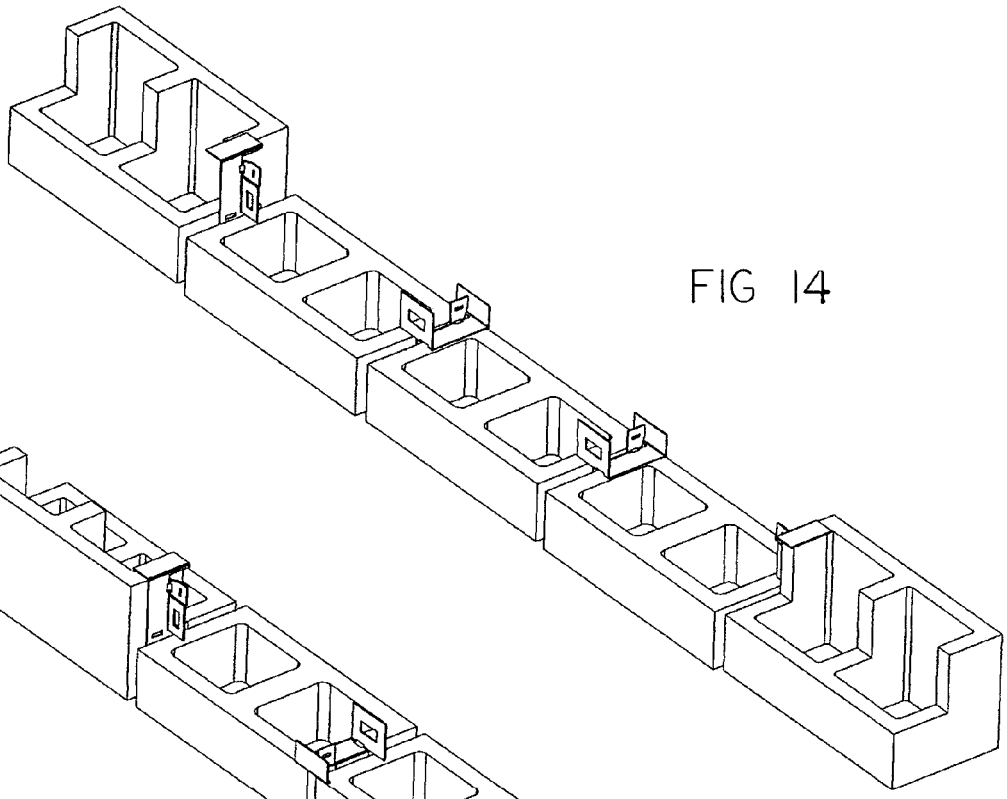

The TRAY should be trimmed so the long axis of the TRAY fits between the chair blocks that define the width of the rough opening. This can be done on the job-site using tools that will cut sheet metal. The locking tabs on the CLIPS that are positioned between the half-high blocks should be bent up to a vertical position and given a slight twist. The slight twist will create enough clearance for the front of the TRAY (reference character C) to slip between the face flange (reference character E) and the locking tab of the CLIP. The mounting and support tab (reference character H) of the CLIPS that are positioned between the half-high blocks should be bent up to a vertical position. FIGS. 13 and 14 show CLIPS in the middle of the rough opening that have been bent in the prescribed manner. Next, the TRAY is placed in the rough opening with the front (reference character C) of the TRAY set against the inside of the face flanges (reference character E) between the face flange and the locking tab of the CLIPS that lie between the half-high blocks. The TRAY will be resting with its bottom surface (reference character B) on the upper edge of the mounting and support tab. The locking tabs are then untwisted to form a lock on the lower edge of the front of the TRAY. The relative position of these CLIPS and the TRAY can be seen in FIGS. 22 and 23. With the TRAY in this position it will also be resting on the mounting and locking flange (reference character G) of the CLIPS at the chair blocks. The positional relationship of the TRAY and the CLIPS in this location is shown in FIGS. 18 and 19. The locking tabs (reference character F) of the CLIPS at the chair block can now be bent over the top surface of the TRAY (reference character A). The positional relationship of a TRAY and a CLIP at this stage of installation is shown in FIGS. 20 and 21. Note that the locking tab has been bent out perpendicular to the chair block side. This can be seen in the finished installation in FIG. 17. A TRAY with cutouts so the CLIPS can be seen in the final stage of installation is shown in a rough opening in FIGS. 14 and 15. A completed assembly can also be seen in FIGS. 24, 25, and 26.

The invention claimed is:

1. A threshold fray and clip system comprising a tray comprising an elongated form including a plurality of sections, said sections including a planar step section with a front end, back end, left end, and right end; and a riser section having a top end and a bottom end and being substantially perpendicular to, extending downwardly from and adjoining the step section, said top end of the riser section adjoining the front end of the planar step section; and a kick section having a top end and a bottom end and being substantially perpendicular to, extending upwardly from and adjoining the step section, said bottom end of the kick section adjoining the back end of the planar step section; and an angled keeper lip section having a top end and a free end and extending downwardly from and adjoining the riser section, said top end of the angled keeper lip section adjoining the bottom end of the riser section, said free end of the angled keeper lip section being angled toward the back end of the step section; and a plurality of clips adapted for engaging and supporting said tray, at least one of said clips including an angled aperture adapted for receiving the angled keeper lip of the tray, and at least another one of said clips including a mounting and support tab adapted for supporting the step section of the fray.

2. A threshold tray and clip system according to claim 1, wherein said plurality of clips include at least one clip comprising a face flange, and a clip base having a front end, a back end, a right side and a left side, said clip base further including a plurality of tabs configured for bending to an orientation perpendicular to said clip base, said tabs including a mounting and support tab located at the back end of the clip base, a mounting and locking flange located between the front end and back end of the clip base at the right side of the clip base, a locking tab located near the front end of the clip base at the right side of the clip base, and said face flange having a top end and a bottom end and being substantially perpendicular to, extending upwardly from and adjoining the clip base, said top end of the face flange adjoining the front end of the clip base, and said angled aperture being formed between said face flange and said locking tab, said locking tab being bendable to an orientation perpendicular to and extending upwardly from said clip base.

3. A threshold tray and clip system according to claim 2, wherein said mounting and support tab located at the back end of the clip base is bent to an orientation perpendicular to and extending upwardly from said clip base.

4. A threshold tray and clip system according to claim 3, wherein said mounting and locking flange located between the front end and back end of the clip base is bent to an orientation perpendicular to and extending downwardly from said clip base.

5. A threshold fray and clip system according to claim 1, wherein said plurality of clips include a plurality of mortar apertures adapted for receiving mortar during setting.

6. A threshold tray and clip system according to claim 1, wherein said plurality of clips include at least one half-high block clip comprising a face flange, and a clip base having a front end, a back end, a right side and a left side, said clip base further including a plurality of tabs perpendicular to said clip base, said tabs including a mounting and support tab located at the back end of the clip base, a mounting and locking flange located between the front end and back end of the clip base at the right side of the clip base, and configured to extend between abutting sides of adjacent half-high blocks, a locking tab located near the front end of the clip base at the right side of the clip base, and said face flange having a top end and a bottom end and being substantially perpendicular to, extending upwardly from and adjoining the clip base, said top end of the face flange adjoining the front end of the clip base, and said angled aperture being formed between said face flange and said locking tab, said locking tab being perpendicular to and extending upwardly from said clip base.

7. A threshold tray and clip system according to claim 1, wherein said plurality of clips include at least one chair block clip comprising a face flange, and a clip base having a top end, a bottom end, a front side and a back side, said clip base further including a mounting and locking flange located between the top end and bottom end of the clip base, and configured to extend perpendicularly from the clip base in a direction opposite the face flange, said face flange having an adjoined end and a free end and being substantially perpendicular to and adjoining the clip base, said adjoined end of the face flange adjoining the top end of the clip base.

8. A threshold tray and clip system comprising a tray comprising an elongated form including a plurality of sections, said sections including a planar step section with a front end, back end, left end, and right end; and a riser section having a top end and a bottom end and being substantially perpendicular to, extending downwardly from and adjoining the step section, said top end of the riser section adjoining the front end of the planar step section; and a kick section having a top end and a bottom end and being substantially perpendicular to, extending upwardly from and adjoining the step section, said bottom end of the kick section adjoining the back end of the planar step section; and an angled keeper lip section having a top end and a free end and extending downwardly from and adjoining the riser section, said top end of the angled keeper lip section adjoining the bottom end of the riser section, said free end of the angled keeper lip section being angled toward the back end of the step section; and a plurality of clips adapted for engaging and supporting said tray, including at least one chair block clip comprising a face flange, and a clip base having a top end, a bottom end, a front side and a back side, said clip base further including a mounting and locking flange located between the top end and bottom end of the clip base, and configured to extend perpendicularly from the clip base in a direction opposite the face flange, said face flange having an adjoined end and a free end and being substantially perpendicular to and adjoining the clip base, said adjoined end of the face flange adjoining the top end of the clip base.

9. A threshold tray and clip system according to claim 8, wherein said plurality of clips include at least one clip comprising a face flange, and a clip base having a front end, a back end, a right side and a left side, said clip base further including a plurality of tabs configured for bending to an orientation perpendicular to said clip base, said tabs including a mounting and support tab located at the back end of the clip base, a mounting and locking flange located between the front end and back end of the clip base at the right side of the clip base, a locking tab located near the front end of the clip base at the right side of the clip base, and said face flange having a top end and a bottom end and being substantially perpendicular to, extending upwardly from and adjoining the clip base, said top end of the face flange adjoining the front end of the clip base, and an angled aperture being formed between said face flange and said locking tab, said locking tab being perpendicular to and extending upwardly from said clip base.

10. A threshold fray and clip system according to claim 9, wherein said mounting and support tab located at the back end of the clip base is bent to an orientation perpendicular to and extending upwardly from said clip base.

11. A threshold fray and clip system according to claim 10, wherein said mounting and locking flange located between the front end and back end of the clip base is bent to an orientation perpendicular to and extending downwardly from said clip base.

12. A threshold tray and clip system according to claim 11, wherein said plurality of clips include a plurality of mortar apertures adapted for receiving mortar during setting.

13. A threshold fray and clip system according to claim 12, wherein said plurality of clips include at least one half-high block clip comprising a face flange, and a clip base having a front end, a back end, a right side and a left side, said clip base further including a plurality of tabs perpendicular to said clip base, said tabs including a mounting and support tab located at the back end of the clip base, a mounting and locking flange located between the front end and back end of the clip base at the right side of the clip base, and configured to extend between abutting sides of adjacent half-high blocks, a locking tab located near the front end of the clip base at the right side of the clip base, and said face flange having a top end and a bottom end and being substantially perpendicular to, extending upwardly from and adjoining the clip base, said top end of the face flange adjoining the front end of the clip base, and said angled aperture being formed between said face flange and said locking tab, said locking tab being perpendicular to and extending upwardly from said clip base.

14. A step in a concrete floor, said step comprising an elongated form including a plurality of sections, said sections including a planar step section with an exposed surface and a back surface; and a riser section having an exposed surface and a back surface, and including a top end and a bottom end and being substantially perpendicular to, extending downwardly from and adjoining the step section, said top end of the riser section adjoining the front end of the planar step section; and a kick section having an exposed surface and a back surface, and including a top end and a bottom end and being substantially perpendicular to, extending upwardly from and adjoining the step section, said bottom end of the kick section adjoining the back end of the planar step section; and a plurality of clips adapted for engaging and supporting said elongated form, including at least one chair block clip; and wherein said plurality of clips are embedded in concrete and said elongated form is implanted in concrete with the exposed surfaces of the kick, riser and planar step section being substantially uncovered by concrete.

* * * * *